US006877726B1

(12) United States Patent
Rindt et al.

(10) Patent No.: US 6,877,726 B1
(45) Date of Patent: Apr. 12, 2005

(54) SATURATION VESSEL FOR USE IN THE TREATMENT OF WASTE WATER

(76) Inventors: John R. Rindt, 1219 83rd St. South, Grand Forks, ND (US) 58201; Don V. Mathsen, 1011 19th Ave. South, Grand Forks, ND (US) 58201

( * ) Notice: Subject to any disclaimer, the term of this patent is extended or adjusted under 35 U.S.C. 154(b) by 162 days.

(21) Appl. No.: 10/319,165

(22) Filed: Dec. 13, 2002

Related U.S. Application Data

(60) Provisional application No. 60/342,445, filed on Dec. 19, 2001.

(51) Int. Cl.[7] ..... B01F 3/04

(52) U.S. Cl. ..... 261/111; 261/113; 210/198.1

(58) Field of Search ..... 261/108, 111, 261/113, 115, 116, 118; 210/198.1

(56) References Cited

U.S. PATENT DOCUMENTS 641,684 A * 1/1900 Ferry ..... 261/159
1,471,260 A * 10/1923 Hartman ..... 261/95
2,068,094 A * 1/1937 Webre ..... 239/500
2,239,936 A * 4/1941 Simons ..... 261/111
2,568,875 A * 9/1951 Wethly et al. ..... 261/111
2,702,236 A * 2/1955 Clark ..... 422/257
3,061,204 A * 10/1962 Macinnes et al. ..... 239/500
3,932,282 A 1/1976 Ettelt ..... 210/195
4,350,302 A * 9/1982 Gruber et al. ..... 239/500
5,015,370 A * 5/1991 Fricano ..... 210/138
6,074,554 A 6/2000 Ray et al. ..... 210/194
6,126,815 A 10/2000 Kelada ..... 210/94
6,623,635 B2 * 9/2003 Barnes ..... 210/188

* cited by examiner

*Primary Examiner*—Scott Bushey
(74) *Attorney, Agent, or Firm*—Thomte, Mazour & Niebergall; Shane M. Niebergall

(57) ABSTRACT

A saturation vessel for treating waste water is provided with a hollow body member having a fluid inlet and outlet. A plurality of diffuser plates are positioned one above the other within the body member. A perforated screen member surrounds the diffuser plates. Waste water engages the diffuser plates and the screen to increase the saturation level of air within the waste water. The fluid outlet discharges the air-saturated water to a desired location. The level of waste water agitation is varied by changing the shape and configuration of the diffuser plates and screen member.

15 Claims, 4 Drawing Sheets

SATURATION VESSEL FOR USE IN THE TREATMENT OF WASTE WATER

CROSS-REFERENCE TO RELATED APPLICATION

This application claims the benefit of U.S. Provisional Application Ser. No. 60/342,445 entitled A SATURATION VESSEL FOR USE IN THE TREATMENT OF WASTE WATER filed Dec. 19, 2001, the disclosure of which is hereby incorporated herein by reference.

BACKGROUND OF THE INVENTION

This invention relates to a saturation vessel for use in the treatment of waste water and more particularly to a saturation vessel wherein the waste water is saturated with air prior to further treatment thereof.

DESCRIPTION OF THE RELATED ART

The use of small air bubbles in the separation of suspended solids and/or floatable materials from processed waste water has been known for some time. Typically, the process is referred to as dissolved air floatation or DAF. In dissolved air floatation (DAF), air at high pressure is dissolved in a slipstream or full stream of the waste water to be treated and introduced into a floatation tank at a low pressure along with the rest of the waste stream. When the pressure is reduced, micrometer-size air bubbles are released and rise through the liquid pool contacting and lifting any floatable suspended matter to the surface of the liquid pool.

Floatation units typically refer to their efficiency in two generalized numerical formats. The first is (1) as the surface area required to separate a unit mass of solids, while the second is (2) the percent solids in the separated, solids rich process stream. The development and application of micro-bubbles (typically around 30 micron mean bubble diameter) to the separation of waste water solid from waste water has shown that smaller bubbles can lead to higher loadings of solids per unit area. The process of producing micro-bubbles is a two-stage process. The first is to saturate a portion of the clean effluent with air at an elevated pressure. The higher the pressure, the greater quantity of air is dissolved and is thus available to the resulting mixture of super-saturated water-air solution and waste water stream for lifting suspended solids and/or floatable material. The super-saturated water-air mixture is then exposed to very high pressure drops in a carefully crafted nozzle. There are other methods for the generation of micro-bubbles, but they are not commercially significant.

In the past, saturation process has been accomplished using large reservoirs and long residence times with internal mixers to allow for the dissolution of air into the recycle water stream. While this system works, it is quite capital-intensive due to the requirement for large pressure vessels.

SUMMARY OF THE INVENTION

A saturation vessel for use in the treatment of waste water is disclosed which comprises a hollow cylindrical body member having closed upper and lower ends. A fluid inlet is formed in the upper end of the body member for supplying water and pressurized air to the upper end thereof. An air inlet is also formed in the upper end of the body member for supplying pressurized air to the upper end of the body member. A cylindrical screen is positioned within the body member and has a diffuser plate assembly positioned therein. The diffuser plate assembly comprises a plurality of diffuser plates positioned one above the other. Each of the diffuser plates, except the lowermost diffuser plate, comprises a hollow central throat or hub portion, having upper and lower ends and inner and outer sides, and a plate portion extending laterally therefrom adjacent the lower end thereof. The throat portion of each of the diffuser plates, except for the lowermost diffuser plate, is designed to divert a portion of the downwardly flowing water thereinto so that water is directed onto the plate portion and is diverted laterally outwardly towards the cylindrical screen. Each of the plate portions includes a series of sharp ridges or edges incorporated therein. As the water-air mixture flows over the sharp edges, both turbulence and pressure fluctuations increases the mass transfer of air into the water. The throat portions of the diffuser plates progressively decrease in diameter. The hub of the lowermost diffuser plate does not have an open throat portion.

It is therefore a principal object of the invention to provide an improved saturation vessel.

A further object of the invention is to provide an improved saturation vessel for use in the treatment of waste water.

These and other objects will be apparent to those skilled in the art.

DESCRIPTION OF THE PREFERRED EMBODIMENT

Figure 1:
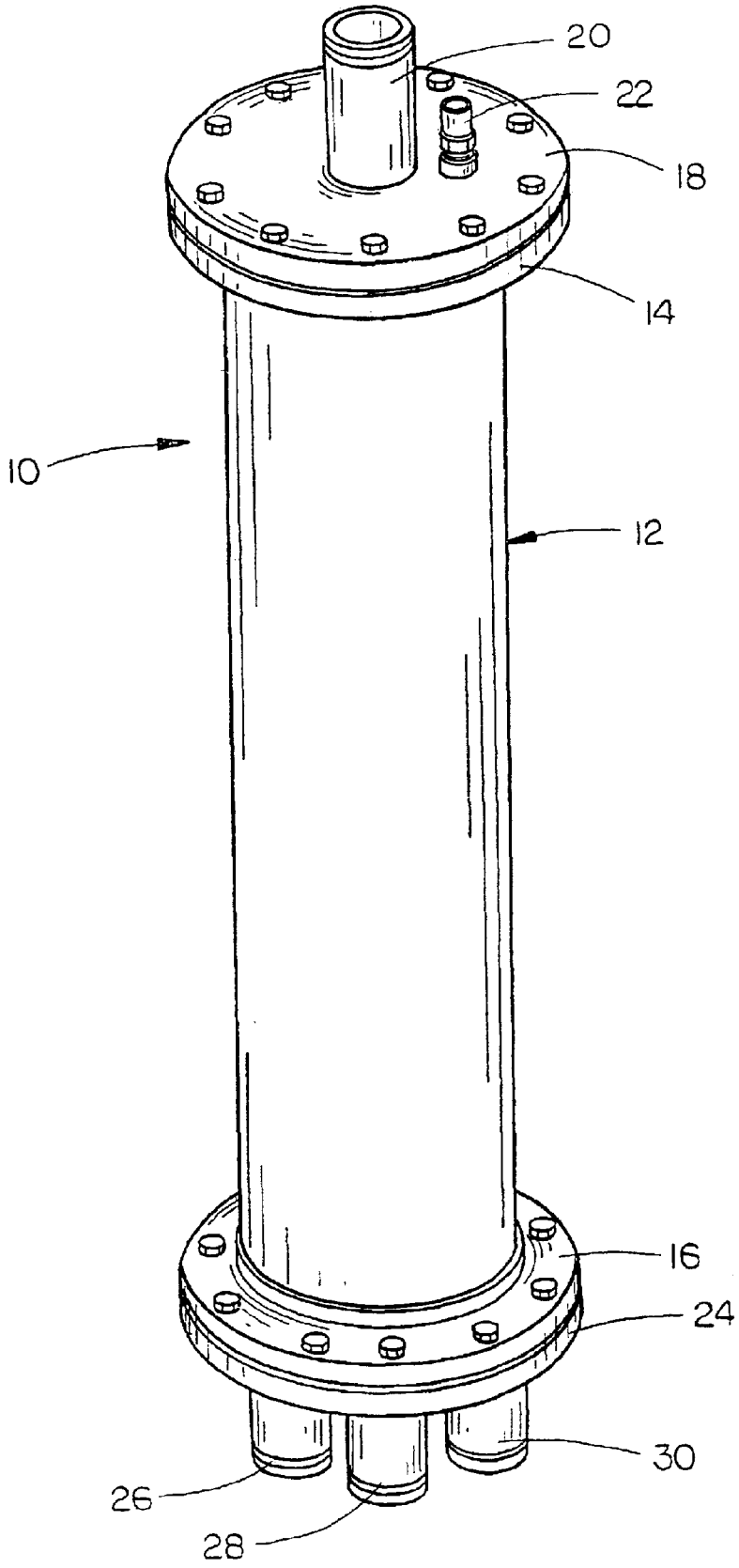
FIG. 1 is a perspective view of the saturation vessel of this invention.

The saturation vessel of this invention is referred to generally by the reference numeral 10 and includes a hollow metal cylindrical body member 12 having upper and lower ends which are provided with annular plates 14 and 16, respectively, secured thereto by welding or the like. Plate 18 is secured to plate 14 by bolts or the like and effectively closes the upper end of the body member except for the inlet ports 20 and 22 extending upwardly therefrom. Plate 24 is secured to plate 16 by bolts or the like and effectively seals the lower end of the body member 12 except for the discharge ports 26, 28 and 30 mounted therein. Inlet port 20 is in communication with a source of water and pressurized air while port 22 is in communication with a source of pressurized air.

The numeral 32 refers to a cylindrical perforated screen which is positioned in the interior of body member 12, as seen in the drawings. The numeral 34 refers to a diffuser plate assembly which is positioned within the cylindrical screen 32. Diffuser plate assembly 34 includes a plurality of spaced-apart support rods 36 having a plurality of diffuser plates 38 mounted thereon, one above the other, as seen in the drawings. For purposes of description, the top diffuser plate will be designated with the reference numeral 38A while the bottom diffuser plate will be designated by the reference numeral 38C. The intermediate diffuser plates will be designated by the reference numerals 38B.

The diffuser plates 38A and 38B are essentially identical except for one design feature, as will be described hereinafter. Each of the diffuser plates 38A and 38B includes a hollow hub or throat portion 40 having an inside surface 42 and an outside surface 44 which is tapered downwardly and outwardly, as seen in the drawings. Plate portion 46 extends laterally outwardly from the throat portion 40 adjacent the lower end thereof and includes upper and lower surfaces 48 and 50, respectively. The upper surface 48 extends upwardly and outwardly from the throat portion 40 and is provided with a series of sharp ridges or edges 52 for a purpose to be described hereinafter. The inside diameter of the throat portion 40 progressively decreases from diffuser plate 38A to the lowermost diffuser plate 38B so that each of the throat portions will receive and divert a portion of the downwardly flowing treated/processed waste water onto the plate portions thereof. The only difference between bottom diffuser plate 38C and the other diffuser plates is that the throat portion 40 thereof is closed so that water does not pass downwardly therethrough, but is diverted downwardly and outwardly onto the plate portion 46C.

The saturation vessel 10 of this invention functions as follows. Saturation vessel 10 of this invention is designed to operate on the energy available from gravity, and redirection of the momentum of flow in the vessel. There is no appreciable pressure loss using this system which means very high efficiency of operation.

The water enters the vessel 10 from the top, through inlet 20, flowing directly downwardly therefrom. Water and pressurized air is supplied to the body member 12 by means of inlet 20 while pressurized air is supplied to the body member via inlet 22. The air pressure is preferably in the range of 70–120 p.s.i. It is recommended that a vapor lock preventer be provided on the top side of the inlet pipe 20 to allow the water to free-fall in the inlet pipe at conditions less than full pipe flow. This can be accomplished by either having an air inlet to that area, or by having the section of the pipe plumbed to the main vessel body using a small diameter pipe. This allows two things to occur. The first is that the water can maintain a relative fixed velocity in the pipe at even low flow conditions, and the water is placed in an air-filled cavity. While not much contact is accomplished in the pipe, having the air present prior to the next stage is advantageous.

Figure 2:
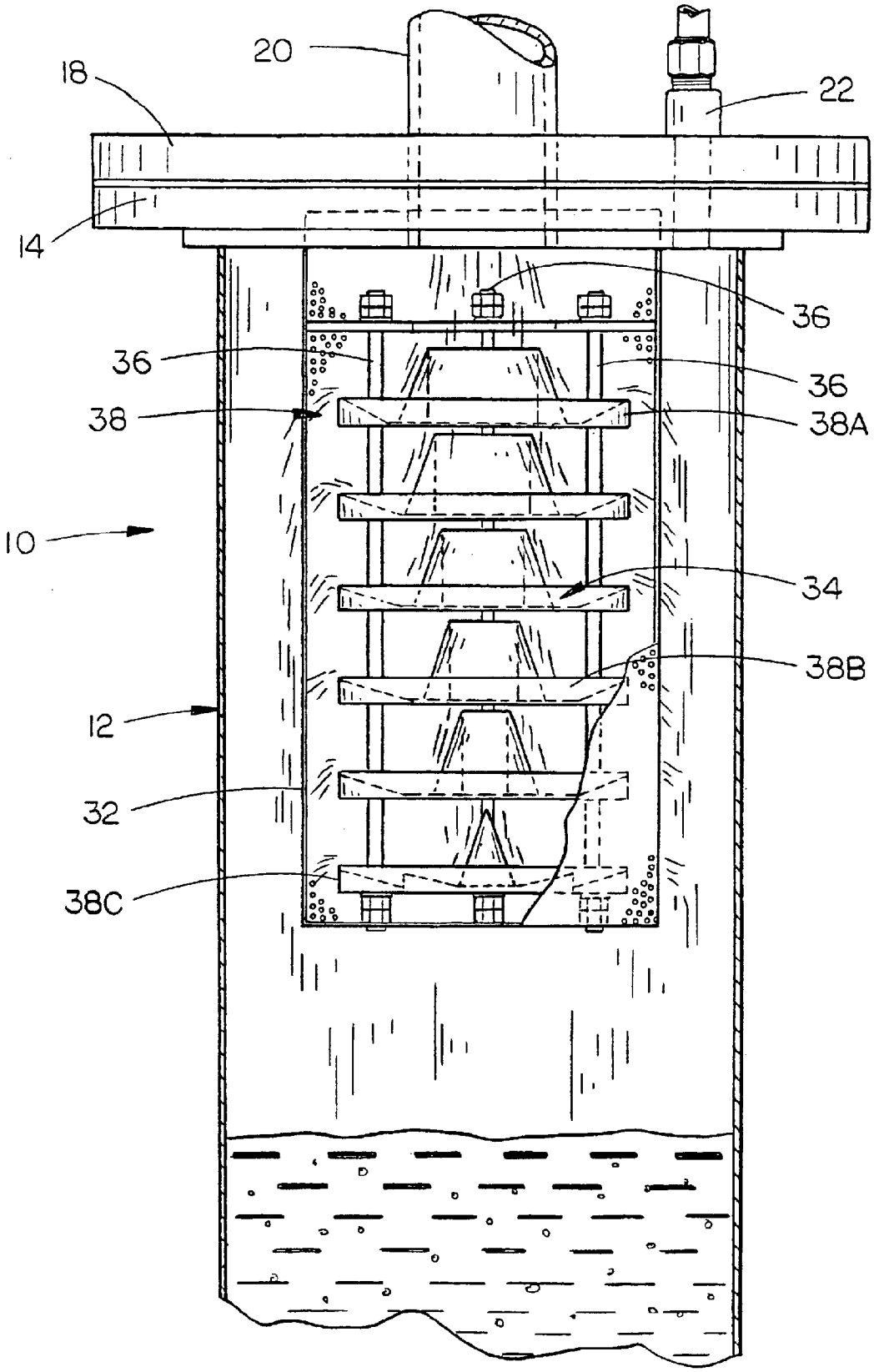
FIG. 2 is a partial sectional view of the saturation vessel of this invention.
Figure 3A:
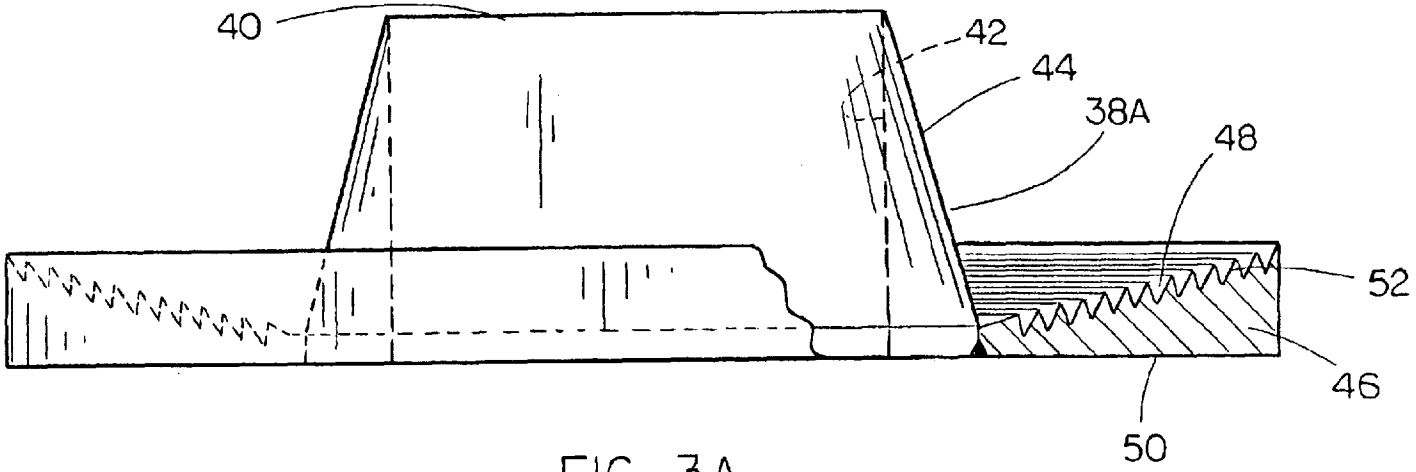
FIG. 3A is a side elevational view of the top diffuser plate of the invention with portions thereof cut away to more fully illustrate the invention.
Figure 3B:
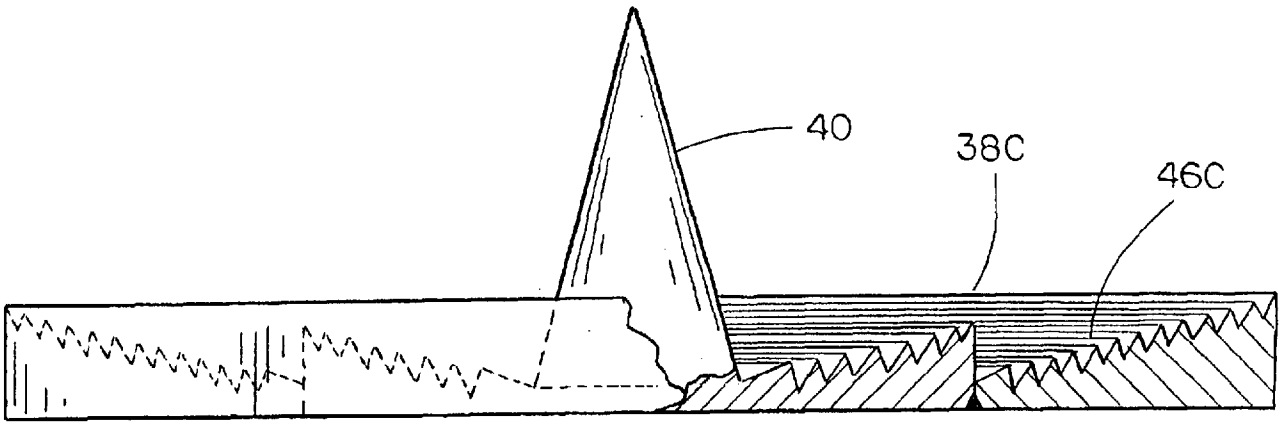
FIG. 3B is a side elevational view of the bottom diffuser plate with portions thereof cut away to more fully illustrate the invention.
Figure 4:
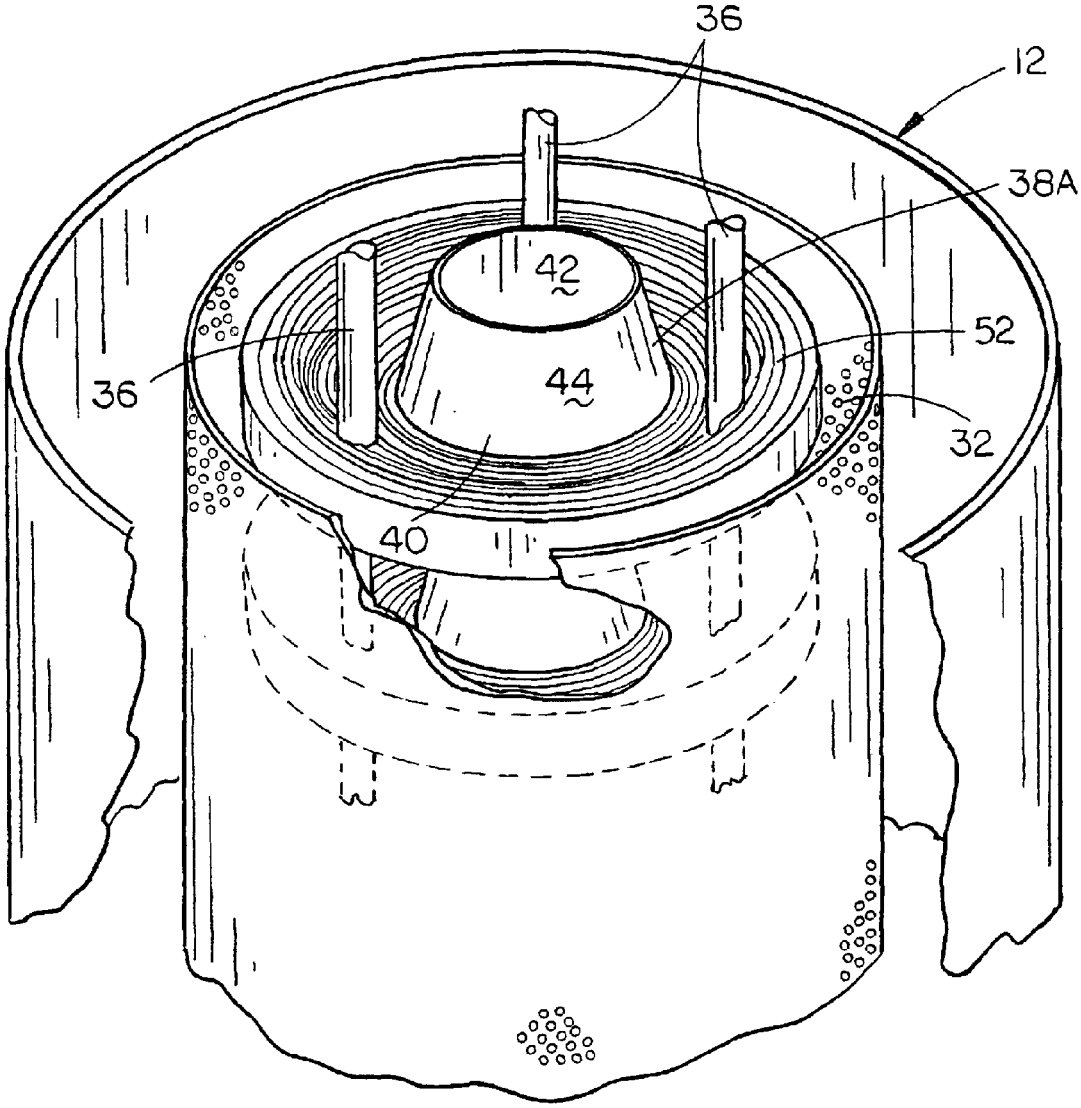
FIG. 4 is a partial prospective view of the upper end of the invention with portions thereof cut away to more fully illustrate the invention.

The next stage of the saturation sequence is to use the downward momentum of the water to create a compression zone. FIG. 2 shows the relationship between the downward flowing water and air streams, and the shear compression zones in the saturation column diffuser plates. The two-phase water-air mixture strikes the sharp upper edge of the upper end of the throat portion of the diffuser plate 38A and an appropriate portion of the total stream is separated and directed down the outer surface 44 of throat portion 40 of diffuser plate 38A. At the bottom of the outer portion of the throat portion 40, the water-air mixture is forced to make a sharp 90° turn which creates both turbulence and localized increased pressure. These two mechanical forces accelerate the mass transfer limited solublization of the water by air.

The next stage is the flow of the water-air mixture over the series of sharp edges or ridges 52 incorporated into the upper surface of the plate portions 46. As the water-air mixture flows over the sharp edges, both turbulence and pressure fluctuations increase the mass transfer of air into water.

The next steps occur as the water is directed outwardly onto the screen 32 which surrounds the saturation column diffuser plate assembly 34. The water-air mixtures leaves the outer edge of the plates with enough velocity to cover the inch or so space between the edge of the plate and the screen and strike the screen with considerable force. These actions increase turbulence and shear and thus increase the exposed water surface to air interface which increases the transfer rate between air and water.

The next step includes two actions, the first being the free-fall of relatively small water droplets from the screen to the water level. By controlling the level of the air-water interface inside the vessel, it is possible to change the level of saturation accomplished during this stage. The small droplets fall through the air and are exposed to the air. Falling droplets of water take advantage of the high water surface area to air exposure. This creates a relatively high transfer rate between the air and water. As a side note, it is possible to control this portion of the saturation process by changing the level of the water-air interface, thereby providing some flexibility in the saturation level during unit operation. The second action is when the falling water hits the surface of the water inside the vessel at the water-air interface. This creates a significant amount of agitation and increased water-air contact providing additional mass transfer.

The sizing of the outlets on the bottom portion of the saturation column is such that an adequate velocity gradient between the water and air exists to allow the undissolved air to remain in the saturation column. While in its current configuration, the unassisted velocity difference (downward velocity of water versus upward velocity of air bubbles) defines the size of the pressure vessel, the volume of the saturation processing can be significantly reduced by using more aggressive separation techniques. These can be hydrocyclones or similar type of separation processes. Utilization of these will provide significant capital expense reductions and improve overall performance compared to currently available methods.

An additional process option is to include a small purge stream from the airspace within the saturation vessel. This is an important option to be able to use since the solubility characteristics of the two main components of air (nitrogen and oxygen) are different. The solubility of nitrogen is less than the solubility of oxygen. If no gas is purged from the head space in the saturation vessel, then the concentration of nitrogen will build up and the head space will contain a high concentration of nitrogen which will reduce the amount of oxygen available to the water simply by dilution. As this can affect the overall efficiency of the saturation column, it can become quite significant.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. A saturation vessel for use in the treatment of waste water, comprising:

a body member having an inner chamber and closed upper and lower end portions;

a fluid inlet formed in the upper end portion of said body member for supplying fluids to the upper end portion of said body member;

a perforated screen member positioned within the inner chamber of said body member;

a diffuser assembly, having upper and lower end portions, positioned within said screen member;

said diffuser assembly comprising a plurality of diffuser plates positioned one above the other; at least one of said diffuser plates comprising an open central throat portion having upper and lower surfaces, having upper and lower ends, and a plate portion having upper and lower surfaces extending laterally therefrom adjacent the lower end thereof; said central throat portion of said at least one of said diffuser plates being tapered downwardly and outwardly; and a fluid outlet formed in the lower end portion of said body member for purging fluids from the lower end portion of said body member.

2. The saturation vessel of claim 1 further comprising an air inlet formed in the upper end portion of said body member for supplying air to the upper end of said body member.

3. The saturation vessel of claim 1 wherein the upper surface of the plate portion of said at least one of said diffuser plates is provided with a plurality of laterally spaced ridge members.

4. The saturation vessel of claim 1 further comprising a purge stream formed in the upper end portion of said body member for the purging of air from within the upper end portion of said body member.

5. The saturation vessel of claim 1 wherein said diffuser plates are shaped to direct said fluids outwardly from said diffuser plates and into engagement with said perforated screen member.

6. The saturation vessel of claim 5 wherein said diffuser assembly and said perforated screen member are positioned within the inner chamber of said body member so that the fluids that engage said perforated screen member collect beneath said diffuser plate assembly and said perforated screen member to define a headspace within said inner chamber.

7. The saturation vessel of claim 6 wherein said fluid outlet and said body member are selectively sized to determine the volume of said headspace.

8. A method of saturating a liquid with a gas, comprising the steps of:

providing a vessel comprising a hollow body member, a plurality of spaced-apart diffuser plates operatively coupled to one another within said body member, and a perforated screen member positioned around said plurality of spaced-apart diffuser plates;

forming a fluid inlet and a fluid outlet in said body member;

forming a plurality of laterally spaced ridge members on said plurality of diffuser plates;

directing the liquid and the gas into said body member through said fluid inlet so that the liquid engages said plurality of spaced-apart diffuser plates and is at least partially directed toward said perforated screen member for engagement therewith and saturating the liquid with the gas; and purging the saturated liquid from said body member through said fluid outlet.

9. The method of claim 8 further comprising the step of forming a purge stream within said body member to allow the selective release of the gas from within the body member.

10. The method of claim 8 further comprising the step of forming a gas inlet in said body member to permit the selective addition of the gas into said body member.

11. The method of claim 8 further comprising the step of shaping the body member and the fluid outlet to selectively define a volume of headspace within the body member.

12. A device for saturating a liquid with a gas, comprising:

a body member having an inner chamber and upper and lower end portions;

a fluid inlet formed in the upper end portion of said body member;

means for engaging the liquid after it is directed into said body member to create turbulence and pressure fluctuations that increase the mass transfer of the gas into the liquid; and a fluid outlet formed in the lower end portion of said body member.

13. The device of claim 12 further comprising a gas inlet formed in said body member to permit the selective addition of the gas within said body member.

14. The device of claim 12 further comprising a purge stream formed within said body member to permit the selective release of the gas from within the body member.

15. The device of claim 12 further comprising means for maintaining a relative fixed velocity of liquid entering the body member irrespective of the level of flow of the liquid at a liquid source.

* * * * *